US010462559B2

(12) United States Patent
Zhang et al.

(10) Patent No.: US 10,462,559 B2
(45) Date of Patent: Oct. 29, 2019

(54) SPEAKER BOX

(71) Applicant: AAC Technologies Pte. Ltd., Singapore (SG)

(72) Inventors: YuGuo Zhang, Shenzhen (CN); Zhang Ren, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/057,939

(22) Filed: Aug. 8, 2018

(65) Prior Publication Data

US 2019/0200118 A1 Jun. 27, 2019

(30) Foreign Application Priority Data

Dec. 21, 2017 (CN) ..... 2017 1 1394020

(51) Int. Cl.
*H04R 1/28* (2006.01)
*H04R 1/02* (2006.01)
*H04R 7/12* (2006.01)

(52) U.S. Cl.
CPC ..... *H04R 1/2888* (2013.01); *H04R 7/127* (2013.01); *H04R 1/025* (2013.01); *H04R 2499/11* (2013.01)

(58) Field of Classification Search
CPC ..... H04R 1/02; H04R 1/023; H04R 1/025; H04R 1/035; H04R 1/345; H04R 1/2803; H04R 1/283; H04R 1/2888; H04R 7/127; H04R 9/06; H04R 3/06; H04R 32/006; H04R 2209/022; H04R 2400/11; H04R 2499/11; H04L 23/473; G10K 11/162
USPC ..... 381/388
See application file for complete search history.

(56) References Cited

U.S. PATENT DOCUMENTS

| | | | | |
|---|---|---|---|---|
| 8,452,037 | B2 * | 5/2013 | Filson | H04R 1/021 381/334 |
| 8,885,867 | B1 * | 11/2014 | Tai | H04R 1/345 381/333 |
| 9,154,865 | B2 * | 10/2015 | Zha | H04R 1/021 |
| 9,386,362 | B2 * | 7/2016 | Filson | H04R 1/021 |
| 9,414,140 | B2 * | 8/2016 | Wang | H04R 1/021 |
| 10,015,586 | B2 * | 7/2018 | Shi | H04R 1/288 |
| 10,028,942 | B2 * | 7/2018 | Estrada | C07D 401/14 |
| 10,225,646 | B2 * | 3/2019 | Qin | H04R 1/2888 |
| 10,334,354 | B2 * | 6/2019 | Qin | H04R 1/2888 |
| 10,356,498 | B2 * | 7/2019 | Yoon | |
| 10,375,469 | B2 * | 8/2019 | Qin | H04R 1/2888 |
| 2007/0036369 | A1 * | 2/2007 | Davi | H04R 1/023 381/150 |
| 2010/0034417 | A1 * | 2/2010 | Wada | H04R 1/025 381/388 |
| 2011/0274303 | A1 * | 11/2011 | Filson | H04R 1/021 381/332 |
| 2013/0259281 | A1 * | 10/2013 | Filson | H04R 1/021 381/332 |

(Continued)

*Primary Examiner* — Binh Kien Tieu
(74) *Attorney, Agent, or Firm* — IPro, PLLC; Na Xu

(57) ABSTRACT

The present application discloses a speaker box. The speaker box includes a lower cover and an upper cover for forming an accommodation space for receiving a speaker. The speaker includes a diaphragm. The upper cover includes a top wall and a side wall extending from the top wall. The speaker box further includes a plate having a main body and a sealing ring. The plate is made of flexible material with a Young's modulus smaller than a Young's modulus of the upper cover.

8 Claims, 2 Drawing Sheets

(56) References Cited

U.S. PATENT DOCUMENTS

| | | | | |
|---|---|---|---|---|
| 2014/0023221 | A1* | 1/2014 | Weinstein | H04R 1/028<br>381/334 |
| 2018/0027322 | A1* | 1/2018 | Shi | H04R 1/288<br>381/353 |
| 2019/0014417 | A1* | 1/2019 | Qin | H04R 9/06 |
| 2019/0200118 | A1* | 6/2019 | Zhang | H04R 1/2888 |

* cited by examiner

SPEAKER BOX

FIELD OF THE PRESENT DISCLOSURE

This disclosure related to the field of electro-acoustic transducers, and more particularly to a speaker box used in a portable electronic device, like a mobile phone.

DESCRIPTION OF RELATED ART

A mobile phone is more and more popular in day life. As one important feature of a mobile phone, music play-back is one of the concerns for a user to choose a phone. A speaker box is a component, or a transducer to convert electrical signals to audible sounds (music).

A related speaker box includes an upper cover, a lower cover forming an accommodation space together with the upper cover, a speaker accommodated in the accommodation space, and a sound passageway communicating with the accommodation space. The upper cover forms a supporting wall for fixing the speaker, and a front sound cavity is formed between the speaker and the upper cover. The sound passageway forms a front cavity cooperatively with the front sound cavity. Generally, the speaker is fixed to the supporting wall only by adhesive. In addition, the speaker box generally provides a sealing foam positioned in the sound passageway.

In the related speaker box, the upper cover is partially made of rigid plastic or metal plate, which produces high frequency distortion of the front sound cavity. At the meantime, the supporting wall is made of rigid plastic so that the buffing ability of the supporting wall is poor and further the stability thereof is not sufficient during dropping. And, the sealing foam is attached to the sound passageway by manual work at low efficiency.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
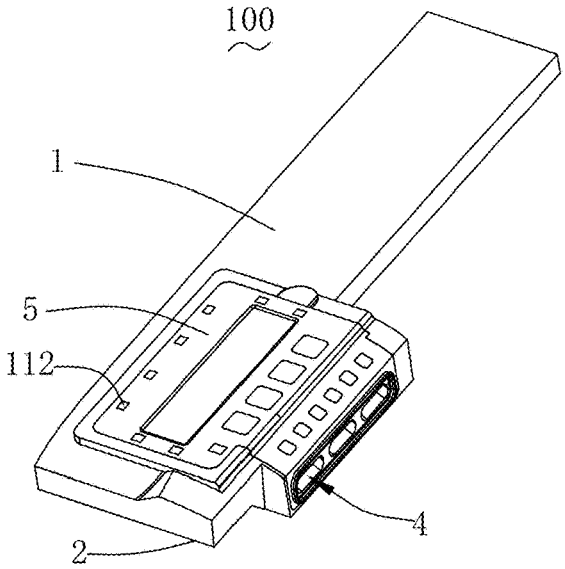
FIG. 1 is an isometric view of a speaker box in accordance with an exemplary embodiment of the present invention.
Figure 2:
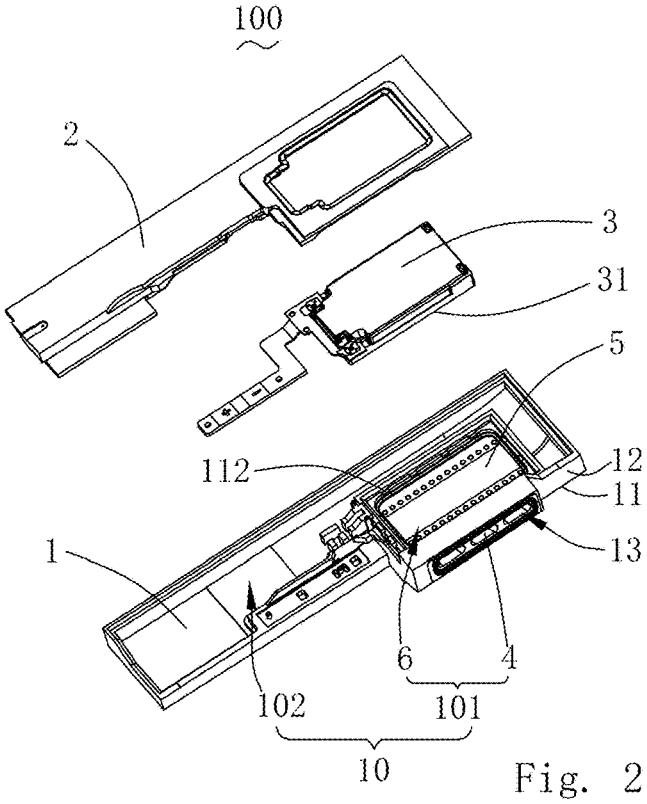
FIG. 2 is an isometric and exploded view of the speaker box in FIG. 1.
Figure 3:
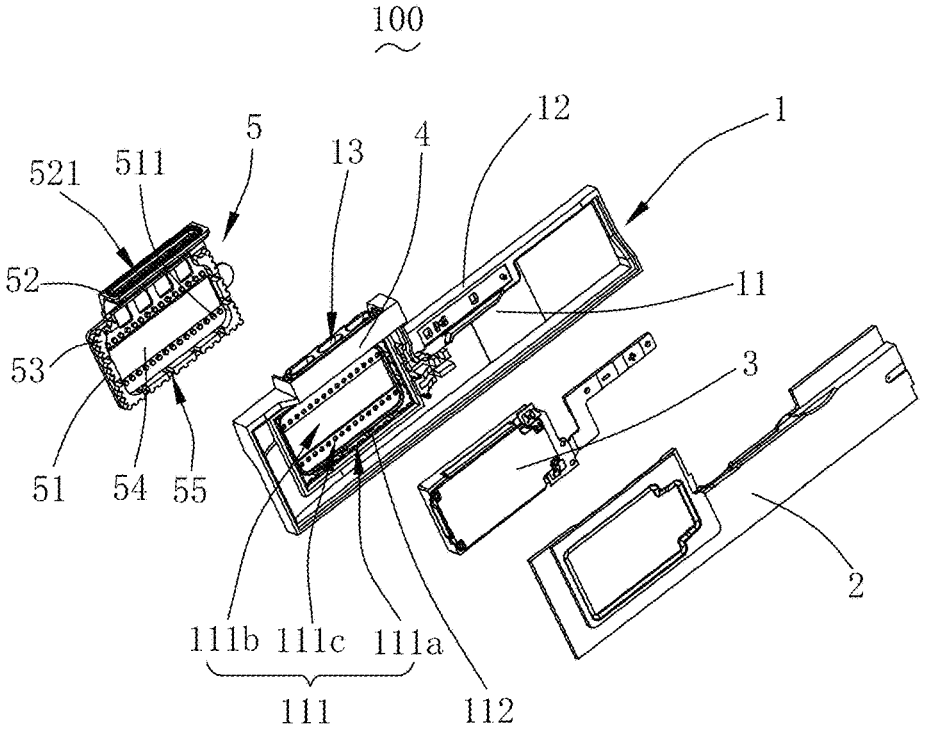
FIG. 3 is an isometric and exploded view of the speaker box in FIG. 1, from another aspect.
Figure 4:
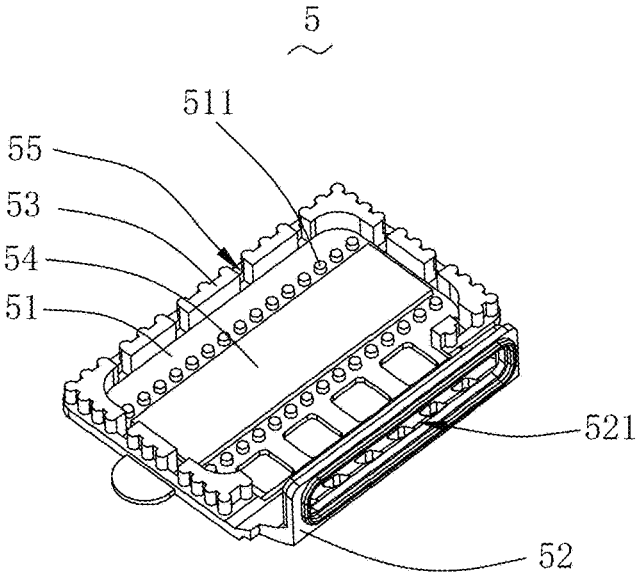
FIG. 4 is an illustrative view of a plate of the speaker box in FIG. 1.

Referring to FIGS. 1-4, an exemplary embodiment of the present invention discloses a speaker box 100 including an upper cover 1, a lower cover 2, an accommodation space 10 formed cooperatively by the upper cover 1 and the lower cover 2, a speaker 3 accommodated in the accommodation space 10, a sound passageway 4, and plate 5. The upper cover 1 can be formed integrally with the lower cover 2, or connected with the lower cover 2. The upper cover 1 further includes a top wall 11 and a side wall 12 extending from the top wall 11 toward the lower cover 2 for fixing the speaker 3. The top wall 11 includes a through hole 111 and a protrusion 112. The through hole 111 includes a first hole 111*a*, a second hole 111*b* spaced from the first hole 111*a*, and a mounting hole 111*c* arranged between the first and second holes 111*a*, 111*b*. The side wall 12 is provided with a sound opening 13. In the embodiment, two first holes 111*a* are provided and the protrusion 112 is disposed between two adjacent first holes 111*a*.

The speaker 3 includes a diaphragm 31 facing the top wall 11. An edge of the speaker 3 is aligned with the first hole 111*a*, and the diaphragm 31 is aligned with the second hole 111*b*. The upper cover 1 and the speaker 3 cooperatively form a front sound cavity 6. In detail, the front sound cavity 6 is formed between the top wall 11 and the speaker 3.

The sound passageway 4 is formed in the upper cover 1. The sound passageway 4 and the front sound cavity 6 cooperatively form a front cavity 101. A rear cavity 102 is formed cooperatively by the speaker 3, the upper cover 1 and the lower cover 2.

The sound passageway 4 communicates with the outside via the sound opening 13. The through hole 111 of the top wall 11 communicates with the front cavity 101. In the embodiment, the through hole 111 communicates with the front sound cavity 6.

The plate 5 includes a main body 51 completely covering the through hole 111, a sealing ring 52 extending from the main body 51 adjacent to the sound opening 13 along a direction from an outer side of the upper cover 1 toward the lower cover 2 to the sound opening 13, a supporting portion 53 extending from the main body 51 toward the front cavity 101 via the first through hole 111*a*, an extending portion 54 extending from the main body 51 toward the front sound cavity 6 via the second through hole 111*b*, and a fastening hole 55. The plate 5 is made of flexible material with a Young's modulus smaller than a Young's modulus of the upper cover 1. The main body 51 forms a stiffening post 511 corresponding to and engaging with the mounting hole 111*c*, which enhances the stability of the engagement between the plate and the upper cover.

The sealing ring 52 is positioned on the side wall 12 and forms an aperture 521 communicating with the sound opening 13. The supporting portion 53 elastically abuts against the edge of the speaker 3 and improves the buffing ability of the speaker 3. In addition, a portion of the speaker 3 away from the top wall 11 is fixed with the lower cover 2. The extending portion 54 is spaced from the diaphragm 31. The fastening hole 55 engages with the protrusion 112 correspondingly. In the embodiment, the sealing ring 52 is integrally formed with the main body 51. The plate is made of soft plastic, such as TPE, TPU, or silica. By virtue of the material of the plate, the resonance frequency of the plate 5 is matched with the resonance frequency of the speaker 3, which reduces the distortion of the speaker and further improves the acoustic performance of the speaker box.

Be notable that the plate 5 is made of flexible material, which means that at least a part of the plate aligned with the through hole 11 is made of flexible material.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including:

a lower cover;

an upper cover forming an accommodation space with the lower cover, the upper cover including a top wall and a side wall extending from the top wall;

a speaker accommodated in the accommodation space, the speaker including a diaphragm facing the top wall;

a front sound cavity formed between the speaker and the top wall;

a sound passageway communicating with outside of the speaker box;

a front cavity formed by the front sound cavity and the sound passageway;

a sound opening formed in the side wall for communicating the sound passageway with the outside;

through holes formed in the top wall and communicating with the front cavity;

a plate assembled with the top wall, the plate including a main body completely covering the through hole and a sealing ring extending from the main body adjacent to the sound opening along a direction from an outer side of the upper cover toward the lower cover to the sound opening, the sealing ring being positioned on the side wall and forming an aperture communicating with the sound opening; wherein the plate is made of flexible material with a Young's modulus smaller than a Young's modulus of the upper cover.

2. The speaker box as described in claim 1, wherein the through hole further includes a first hole aligned with an edge of the speaker, and the plate includes a supporting portion extending from the main body toward the front cavity via the first hole for elastically abutting against the edge of the speaker.

3. The speaker box as described in claim 2, wherein the through hole includes a second hole aligned with the diaphragm and spaced from the first hole, and the plate further includes an extending portion extending from the main body via the second hole.

4. The speaker box as described in claim 3, wherein the through hole includes a mounting hole located between the first hole and the second hole, correspondingly, the main body includes a stiffening post for engaging with the mounting hole.

5. The speaker box as described in claim 2, wherein the first through hole includes at least two holes, and the top wall includes a protrusion located between the at least two holes for engaging with a fastening hole formed in the main body.

6. The speaker box as described in claim 1, wherein the through hole communicates with the front sound cavity.

7. The speaker box as described in claim 1, wherein the main body is integrally formed with the sealing ring.

8. The speaker box as described in claim 1, wherein a portion of the speaker away from the top wall engages with the lower cover.

* * * * *